US005238348A

United States Patent [19]

Reimer

[11] Patent Number: 5,238,348

[45] Date of Patent: Aug. 24, 1993

[54] PARKING SYSTEM

[76] Inventor: Alfred Reimer, 1249 North Shore Blvd., Burlington, Ontario, Canada L7S 1C4

[21] Appl. No.: 686,353

[22] Filed: Apr. 17, 1991

Related U.S. Application Data

[63] Continuation-in-part of Ser. No. 458,457, Dec. 28, 1989, abandoned, which is a continuation-in-part of Ser. No. 283,860, Dec. 13, 1988, abandoned.

[51] Int. Cl.[5] ..... B65G 1/06

[52] U.S. Cl. ..... 414/254; 414/252; 414/255; 414/204; 414/279; 414/281; 104/130

[58] Field of Search ..... 414/252–256, 414/261–262, 264, 273, 279, 281–283; 180/167; 104/130, 264; 191/1 R, 2; 105/130

[56] References Cited

U.S. PATENT DOCUMENTS

| | | | |
|---|---|---|---|
| 2,951,599 | 9/1960 | Bogar | 414/256 |
| 3,412,691 | 11/1968 | Mueller et al. | 105/215.1 X |
| 3,672,305 | 6/1972 | Richins | 104/130 X |
| 3,715,992 | 2/1973 | Park | 104/130 X |
| 3,881,581 | 5/1975 | Richardson | 191/2 |
| 3,934,741 | 1/1976 | Wentz | 414/282 X |
| 3,951,277 | 4/1976 | Hegelman | 414/280 |
| 3,968,888 | 7/1976 | Van Vliet | 414/282 X |
| 4,060,035 | 11/1977 | Swoager | 105/215.1 X |
| 4,252,217 | 9/1981 | Benjamin | 414/284 X |
| 4,538,954 | 9/1985 | Luebke | 414/283 X |

FOREIGN PATENT DOCUMENTS

| | | | |
|---|---|---|---|
| 3545298 | 7/1987 | Fed. Rep. of Germany | 414/282 |
| 3900616 | 7/1989 | Fed. Rep. of Germany | 104/130 |
| 57-4804 | 1/1982 | Japan | 414/282 |
| 58-42505 | 3/1983 | Japan | 414/282 |
| 2068864 | 8/1981 | United Kingdom | 104/130 |
| 2130186 | 5/1984 | United Kingdom | 414/282 |

*Primary Examiner*—Michael S. Huppert
*Assistant Examiner*—James Keenan

[57] ABSTRACT

Parking garage hoist translates on a central 'main' aisle driven by hydraulic translation motor and raises hoist car driven by hydraulic translation motor. Both motors are mounted near the base of the hoist and power for the hydraulic motors is derived from overhead electrical rails and power pick-up with the picked up power converted to hydraulic power. A transverse aisle may be provided to house a hoist for maintenance while another hoist travels on the main aisle. An extension aisle may be provided to house a hoist while another hoist travels on the main aisle.

10 Claims, 14 Drawing Sheets

24
43
28
41
32

52
24
28
47
48
54
46
50
36
38
36
70
56
40
20
40
72
74
46
55
53
51
64
47
68
44
66
51
49
53
26
22
34
30
28
42
30
22

FIG. 22.
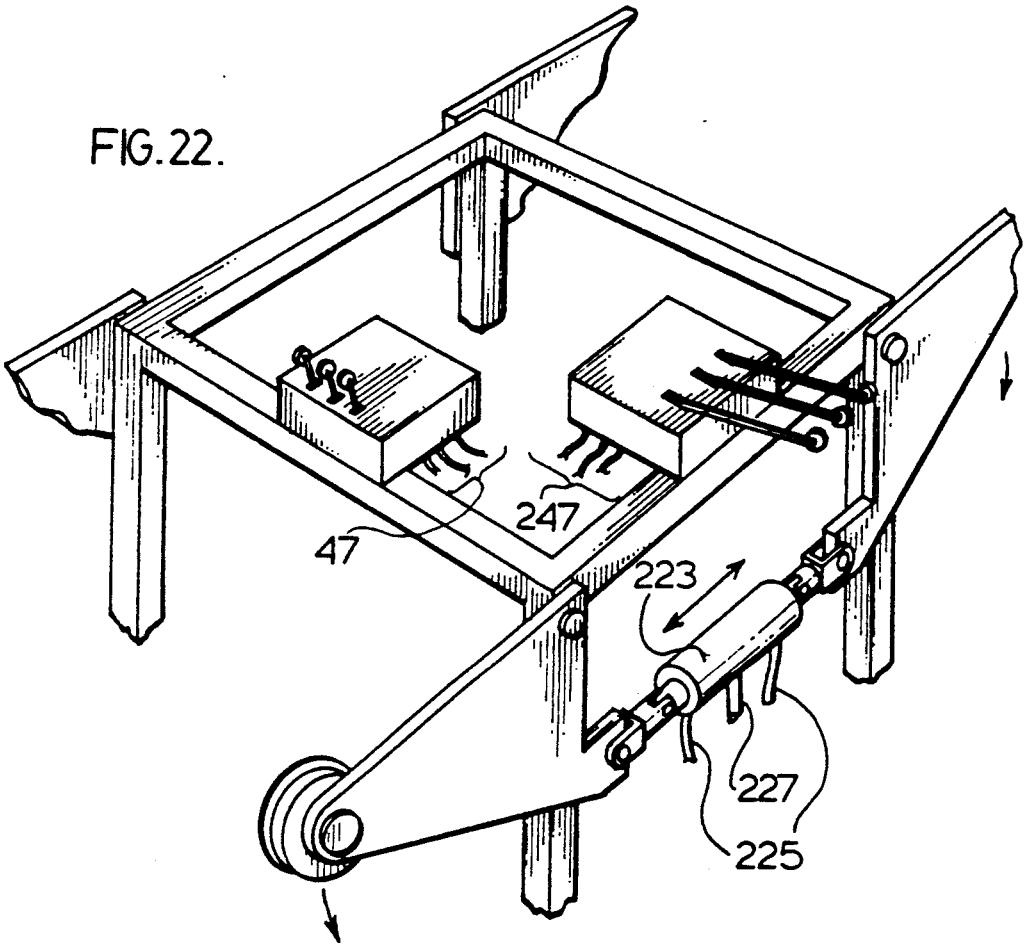
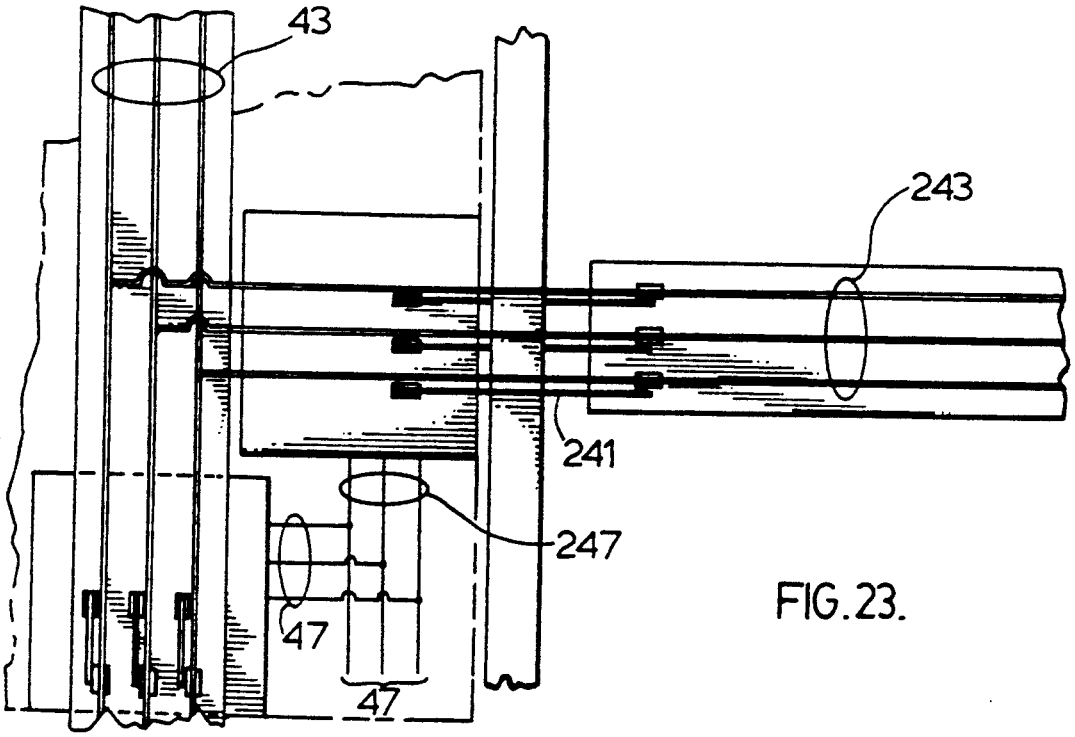
FIG. 23.

PARKING SYSTEM

This application is a continuation-in-part of application Ser. No. 458,457 filed Dec. 28, 1989 which is a continuation-in-part of application Ser. No. 283,860 filed Dec. 13, 1988, both now abandoned.

The invention relates to a parking garage.

It is known to provide parking garages where bays for storage of automobiles are arranged in multiple storeys and means are provided for placing cars in and retrieving cars from said bays.

Previous automobile parking garages have not been designed with facilities for repair of a damaged hoist while a second or replacement hoist is employed in parking and retrieving autos. Thus with prior hoists, in the event of hoist failure no cars may be retrieved or parked until the hoist is repaired. Not only is the failed hoist unuseable but blocks the access of a second hoist to the main aisle or to the parking bays. Thus with prior hoists the failure of a hoist may deprive the garage operator and his customers to auto retrieval or parking for days.

It is an object of the present invention to provide a parking garage for the storage for autos where bays for receiving the autos are arranged in multiple stories facing a substantially straight central aisle and where the autos may be transported between an access-delivery area and any selected bay without use of the automobile motor, thus providing that the space inside the garage will be substantially free of carbon monoxide and other auto engine combustion gases. Moreover, since use of the automobile motor is not required, the car may be locked in distinction to other garages.

It is an object of the invention to provide a parking garage where the automobile, during the process of storage or retrieval, is moved by a hoist movable on main rails horizontally along a main aisle and operable to raise a platform with the auto vertically to the height of the desired bay. Between the horizontal and vertical movements the automobile may be moved by a combination of horizontal and vertical movements between a position aligned with the access-delivery area and a position aligned with any selected storage bay. In accord with the invention the horizontal and vertical motions are controlled by hydraulic motors located at the base of the hoist. It is found that a very efficient, stable and clean operation results.

In a preferred aspect of the invention, a substantially straight transverse aisle is provided extending transversely from the main aisle and designed to house a hoist, clear of the main aisle, for maintenance or repair while another hoist operates on the main aisle to perform its normal functions.

Alternatively the main aisle may be provided with substantially straight extension aisle at each end of the main aisle and extending beyond the bays at one or both ends of the main aisle. With such arrangement, a hoist may be housed in an extension aisle for maintenance or repair while another hoist operates in the main aisle.

In accord with a preferred aspect of the invention, where a transverse aisle is used, a hydraulic motor, located near the base of the hoist, is operable to move such a hoist from the main aisle, into and out of the transverse aisle.

The provision of a transverse or extension aisle to receive a damaged hoist for repair, frees the main aisle, during such repair, for normal operation of the garage with a second hoist performing the parking and retrieval of cars while the first is being repaired. Thus the delay due to a damaged hoist with the invention is the short time to store it on a transverse or extension aisle in contrast to the prior garages where the delay may be hours or days because the damaged hist is there blocking the main aisle.

The operation of the hoists in applicant's garage is facilitated when the preferred hoist design is used where a hoist has a single electrical power take off and each hoist is independently movable and operable. Thus a damaged hoist may be independently moved to the transverse extension or transverse aisle while the replacement hoist is independently moved and operated in the main aisle. Moreover, due to such independent operation two or more hoists may be simultaneously operated in the main aisle.

The main aisle and the alternative transverse or extension aisles must each be substantially straight—that is straight or nearly so. The reason is that the weight of an auto hoist, with an auto thereon is greater than most other articles which would be handled by a hoisting and storage system. For this reason, with a auto parking system it is important to stability and control that the hoist travel in straight or substantially straight lines.

Substantially straight central transverse and extension aisles are required to avoid the centrifugal forces which would occur if the horizontal path were curved. Such centrifugal forces are greater with an automobile hoist than with other hoists because of the comparatively heavier weight of both the structure of an automobile hoist and the weight of the auto carried. The centrifugal force are of course subject to change when the loaded or unloaded hoist platform is raised or lowered. For these reasons substantially straight aisles are required. Without intending any limitation of speeds of operation, it is presently contemplated that hoist horizontal speeds and platform vertical speeds may each be up to ten feet per second. This is exemplary only but gives an idea of the order of potential centrifugal forces or of the changes thereof if the aisle paths were curved.

The heavier weight of the hoist and load in an auto parking garage relative to other travelling hoist suggests the following preferred features of the invention described herein:

(a) The hoist preferably is totally supported from below, as distinct from travelling hoists for other articles which are frequently supported from above. For stability the hoist of the invention may be guided (preferably not supported) from the top.

(b) The inventive hoist preferably has all controls and drive motors located at the bottom of the hoist. The only exception is the actual electric power take off which is more conveniently located at the top of the hoist. However, the power lines from the power take off preferably run directly to the bottom of the hoist to the electric motor.

(c) The inventive hoist is completely self contained as to its electric and hydraulic drives with the single exception of the electric power take-off. This allows each hoist in a multiple hoist system to be operated as an independent vehicle, like an electric trolley both for independent travel along the main aisle and for movement on to the transverse or extension aisles for maintenance and repairs. This self contained arrangement accelerates the overall operation of the garage and facilitates easy and convenient maintenance and repair and without the need for interferring with the operation of other hoists in the garage.

In combination with the inventive hoist movable on main rails along the main aisle, having hydraulic motors mounted on its base for controlling horizontal and vertical movement, there is provided a very convenient power supply having electric lines running above the hoist and running in the translation direction along the main aisle. The hoist is then equipped with power take-offs or 'glides' running on the lines to derive electric power from the lines as does a street car or trolley bus. The electric power is used to drive a hydraulic pump which in turn drives the hydraulic motors to provide horizontal motion of the hoist along the main rails, vertical motion of the hoist platform and preferably also the translation of the cart on the hoist platform. This convenient and efficient provision and usage of electric-hydraulic power provides many advantages among which is that—for an extra-long parking garage two or more hoists may be operated on the same set of translation rails. Each hoist contains complete power sources for movement and operation derived from the electric lines.

In a preferred aspect of the invention, transverse rails are provided extending from the main rails into the transverse aisle and the hoist is provided with transverse wheels to support it on said rails. In this aspect, means are provided for transferring the hoist between support on the main rails and support on the auxiliary rails.

For use in combination with the transverse rails there are preferably provided transverse electric lines running above the hoist along the transverse aisle. The hoist is then provided with power take-offs or glides designed to run on the transverse electric lines to receive the electric power therefrom and utilize it to drive the transverse hydraulic motor. Preferably the electric power is used to drive a hydraulic pump which is then used to drive the transverse hydraulic motor which translates a hoist into and out of the transverse aisle. The hydraulic pump is preferably used to power all other operations on the hoist.

A cart is preferably designed to carry the automobile on a frame having two sets of rods each rod extending to a free end, with each set being designed to support two tires of the automobile. Each storage bay is provided with two sets of parallel rods corresponding respectively to sets of the frame rods but extending in opposite directions (to the frame set to which they correspond) to free ends. The frame and bay rod sets are arranged so that when the cart is in a datum position in a bay, individual rods of the frame rod sets will pass vertically between the bay rods of the set to which they correspond. Thus upward movement of the frame probes will lift an auto on the bay rods for movement on the cart out of the bay, and downward movement of the cart probes relative to the bay rods will leave an auto riding down on the cart rods resting on the bay rods, allowing removal of the cart without the auto. Somewhat similar arrangements for automobile garages are shown in the following patents:

| | | | |
|---|---|---|---|
| 3,054,518 | Coursey | 3,204,785 | Bajulaz |
| 3,301,413 | Coursey | 3,497,087 | Vita |
| RE 27283 | Bajulaz | 2,915,204 | Alimanes |
| U.K. 1,043,371 | | FR 1,107,720 | |

-continued

| | |
|---|---|
| ITAL. 603,913 | FR 1,368,184 |

The use of a hydraulic motor and drum to move the automobile into and out of the bay is found more reliable and convenient than the use of a hydraulic piston.

In general the invention provides a parking garage which may be operated from a single location (usually at the base of the hoist) remote from the storage bays.

Preferably the cart for supporting the automobile may be transferred from the hoist to the bay and vice versa, without movement of the automobile wheels, hence the entire garage is not only operated by remote control but operated without the use of a car motor so that the garage has no ventilation problem because of exhaust gases.

In drawings which illustrate a preferred embodiment of the invention:

FIG. 1 shows a schematic view of the general arrangement of parking garage hoist and hoist platform in accord with the invention:

FIG. 2 is a schematic of the arrangement of the garage as shown on a vertical section taken perpendicular to the horizontal direction along the central aisle, FIG. 3 is a schematic of the arrangement of the garage as shown on a vertical section taken parallel to the horizontal movement direction along the central aisle, FIG. 4 shows the general structure of the hoist and mode of operating the hoist for horizontal movement and the hoist platform for vertical movement, FIG. 5 is a perspective showing the mode of driving the cart for moving to and from the hoist car platform out of and into a storage bay, FIGS. 6 and 7 show the operation of raising and lowering the cart frame, FIG. 8 is a perspective view showing some detail of the complementary rods of the cart and a storage bay, FIGS. 9A–9E show the sequence of providing a car from the hoist platform to a storage bay, FIG. 10 shows a perspective view of means for aligning a hoist platform with a storage bay, FIG. 11 is a vertical section illustrating the final alignment of a platform with a bay, FIG. 12 is a vertical section, partially schematic showing the mode of operating the cart.

Figure 17:
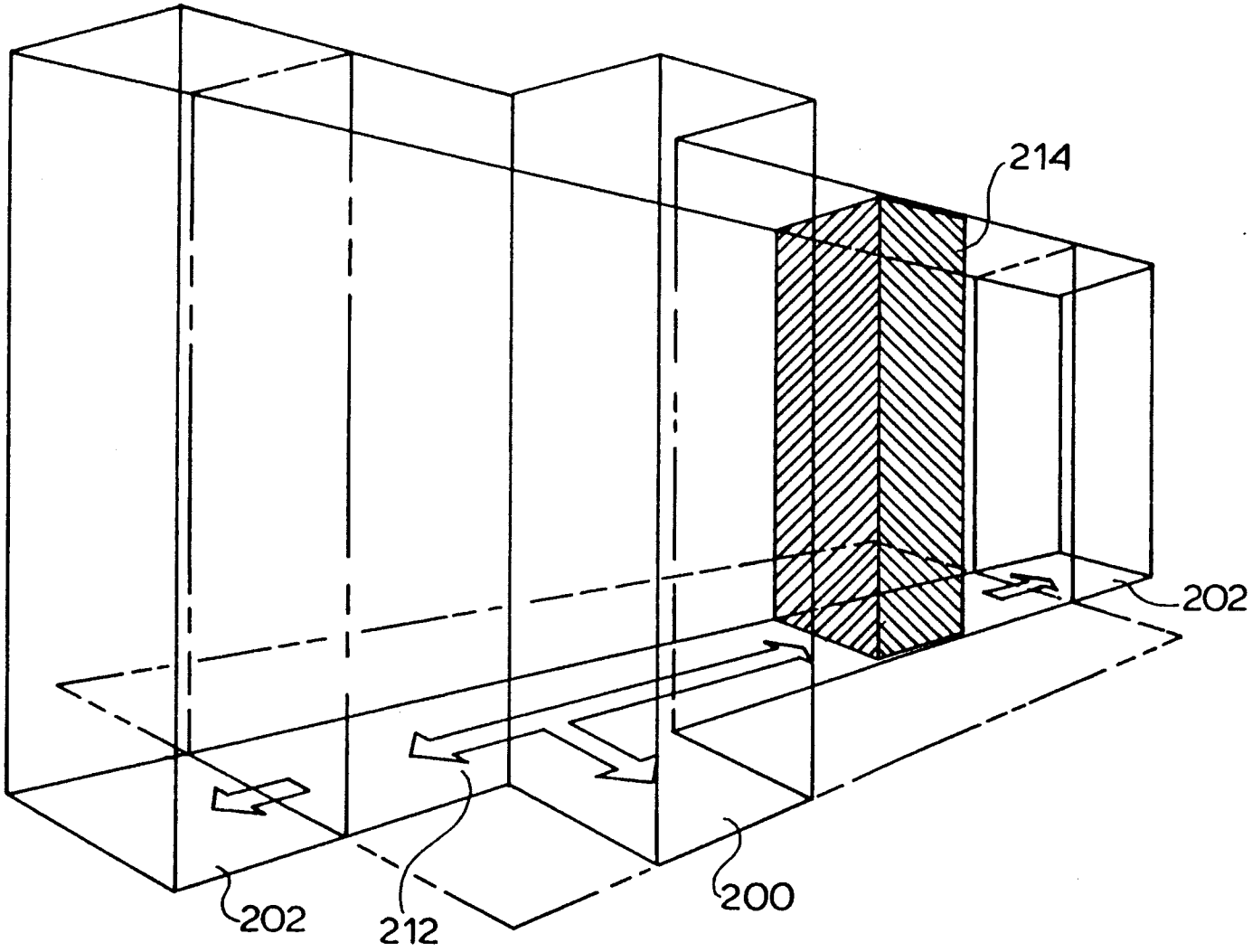
Figure 18:
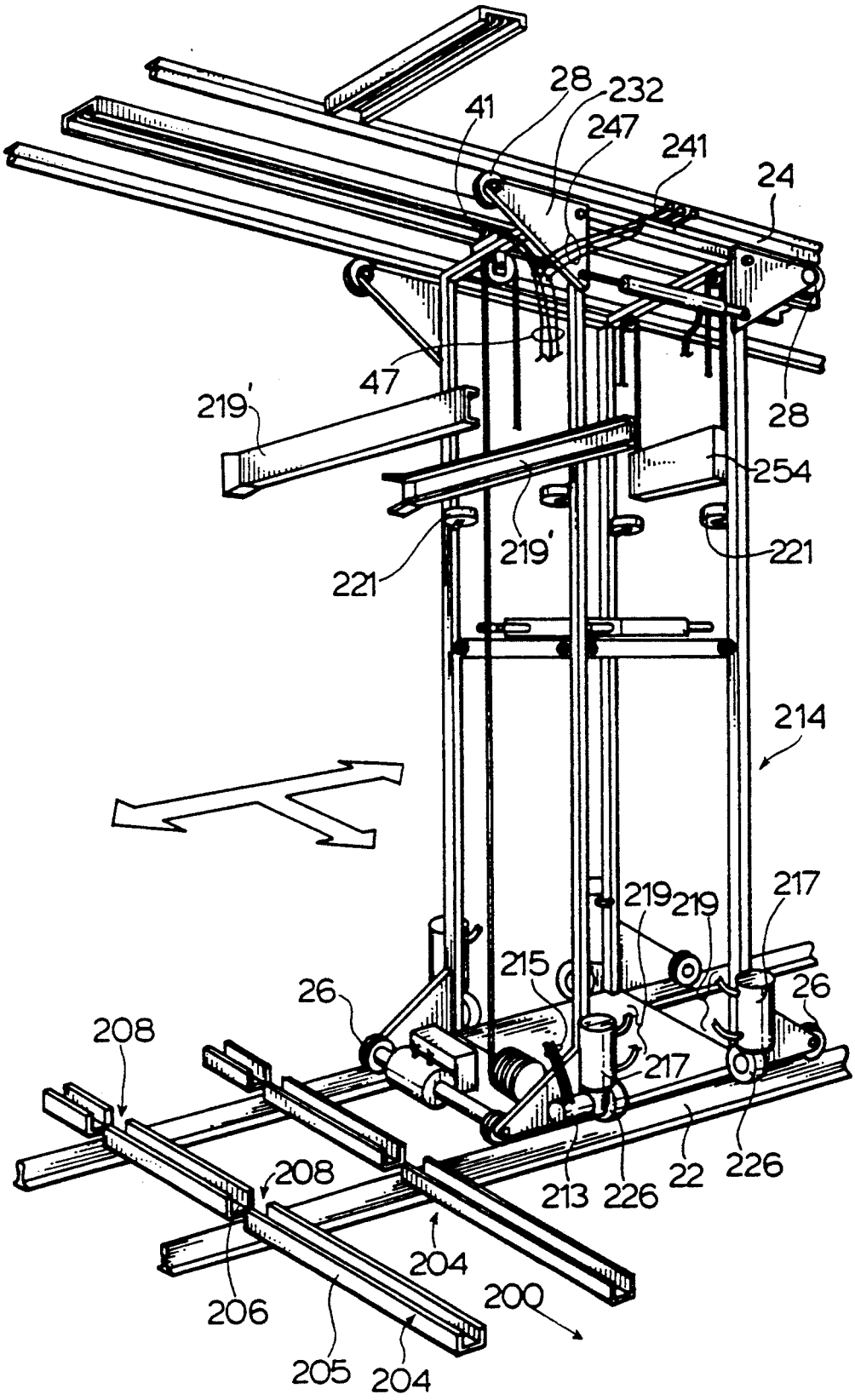
Figure 19:
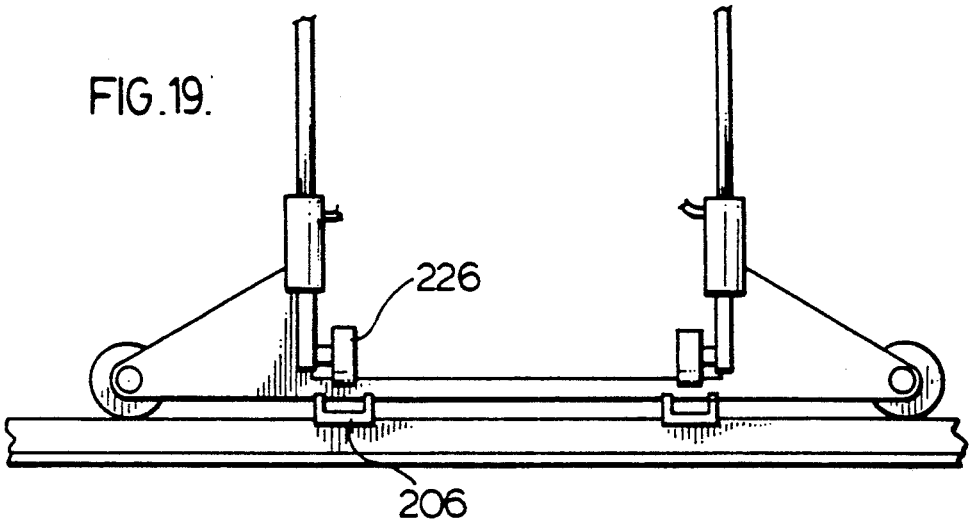
Figure 20:
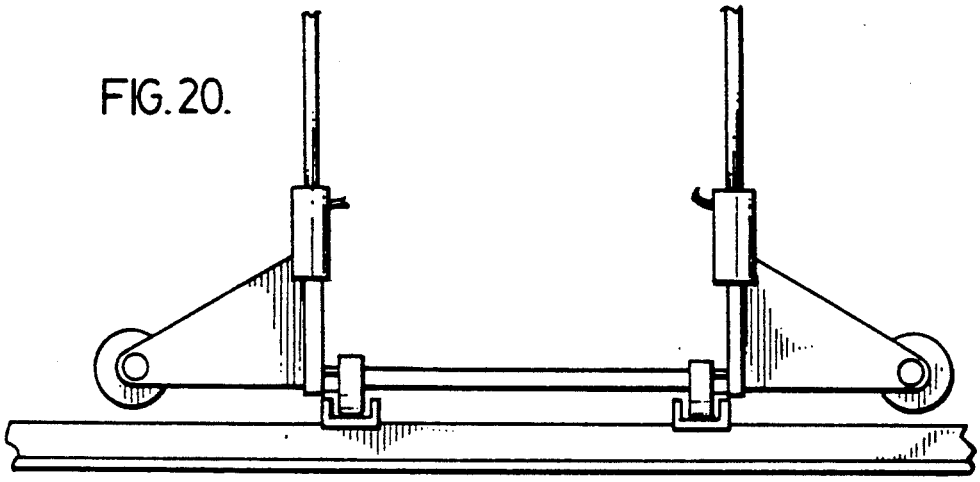
Figure 21:
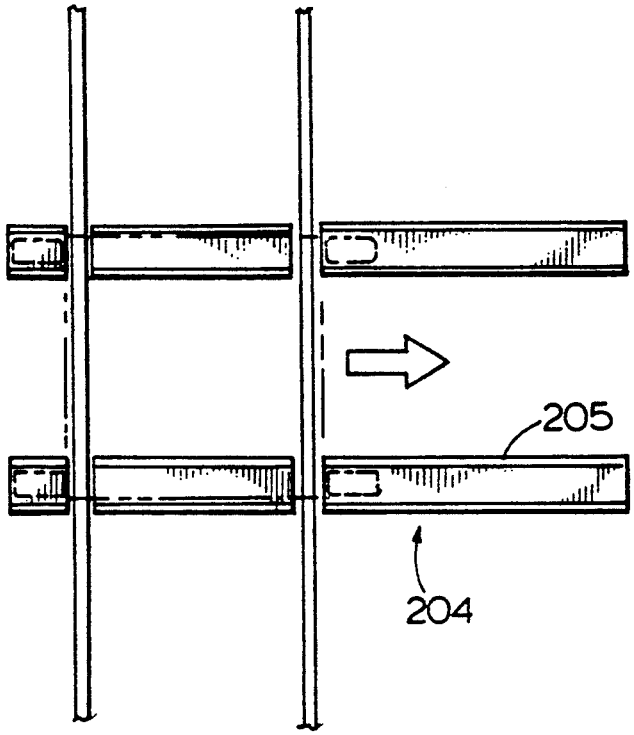
Figure 24:
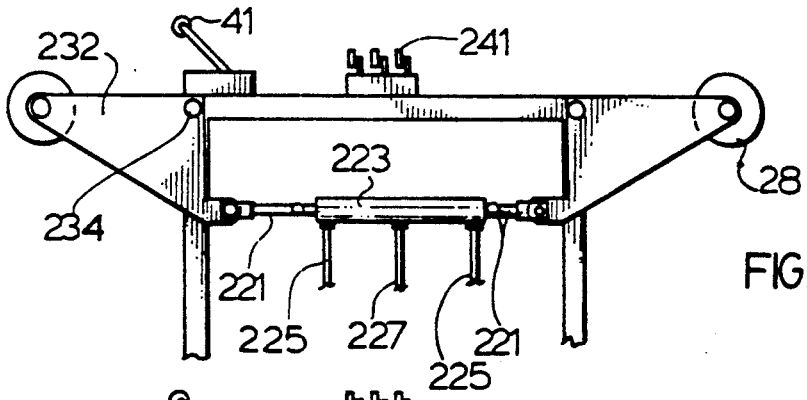
Figure 25:
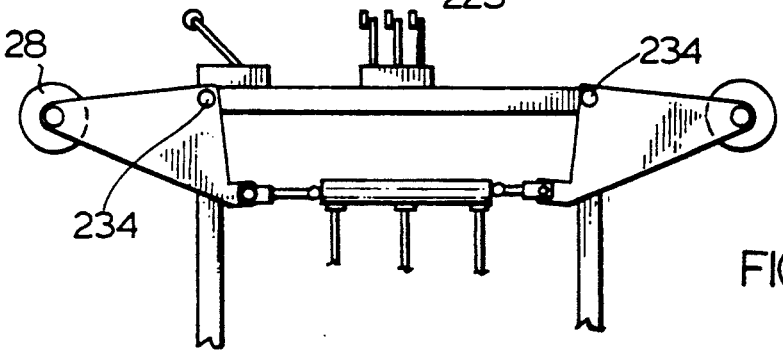
Figure 26:
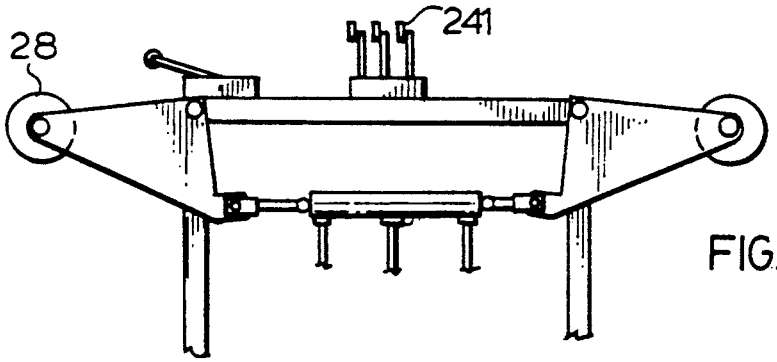
Figure 27:
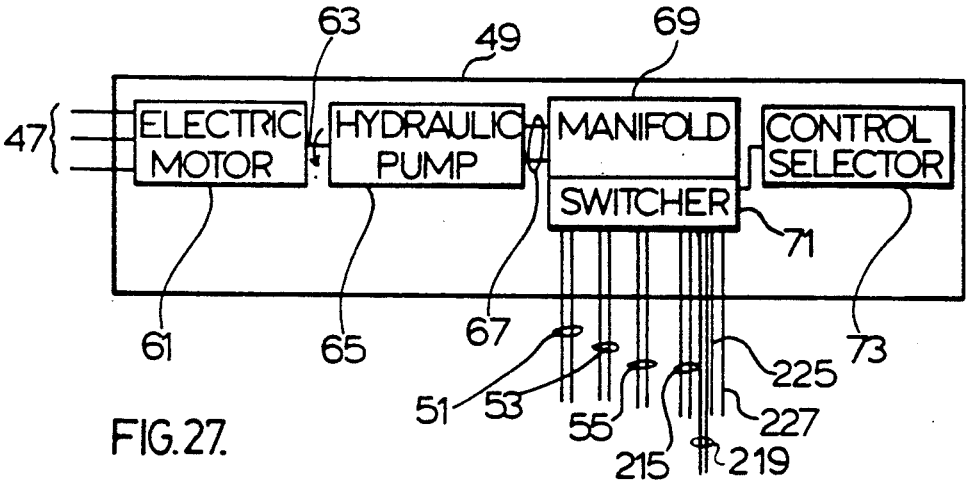

FIG. 17 is a schematic view showing the spatial concept of a parking garage with a main aisle, a transverse aisle and extension aisles FIG. 18 is a partially schematic view showing the main features of a hoist with an indication of the means for translating it along a transverse aisle FIGS. 19 and 20 show schematically the relative positions of main and transverse aisle wheels when using the main and transverse rails respectively, FIG. 21 is a schematic plan view indicating the starting position of the transverse wheels on the transverse rails, FIG. 22 shows schematically the mounts for the hoist power glides FIG. 23 is a schematic plan view of the main and transverse rails, and the glides, FIGS. 24–26 show the position of the main rail wheels and the glides when the hoist is transferring from the main rails to the transverse rails, FIG. 27 is a schematic view of the electric-hydraulic drive.

In the drawings, referring first to FIGS. 1–16, a parking structure comprises opposed arrays of storage bays 10 on each side of a substantially straight central aisle 12. The arrays of opposing bays extend longitudinally along the central aisle and over a predetermined number of storeys of vertical height. I believe it is preferable that the number of storeys not exceed five, particularly where the storeys are all above or below the access level. The bays 10 each provide an opening onto the central aisle through which a cart bearing an auto may be inserted into the selected bay to deposit or retrieve an auto.

A hoist 14 is provided moveable in the central aisle and designed to operate on a lower level 16 than the lowest storey of bays so that the hoist platform may access the bays of any level. Since it is desired to have the weight of the hoist as low as possible and since the hoist translation and vertical motors must be as low as possible on the hoist, the power operating level, that is the main electric-hydraulic drives for the hoist should be below the lowest storage bay.

For convenience of description the aspects of the hoist facing the bays are called the 'sides' of the hoist while the aspects facing along the central aisle are called the 'ends'.

The hoist is provided with an access level 18 to which automobiles may be brought to be driven onto the hoist platform 20. The access may be at one end of the central aisle or may be from the side of the central aisle, as shown, for example, in FIG. 2, although this will usually result in the loss of one or more storage bays.

The access level will be at the base of the structure for an above ground parking lot; at the top for an underground lot and in between (FIG. 2) for structure built partly above and partly below ground.

Figure 1:
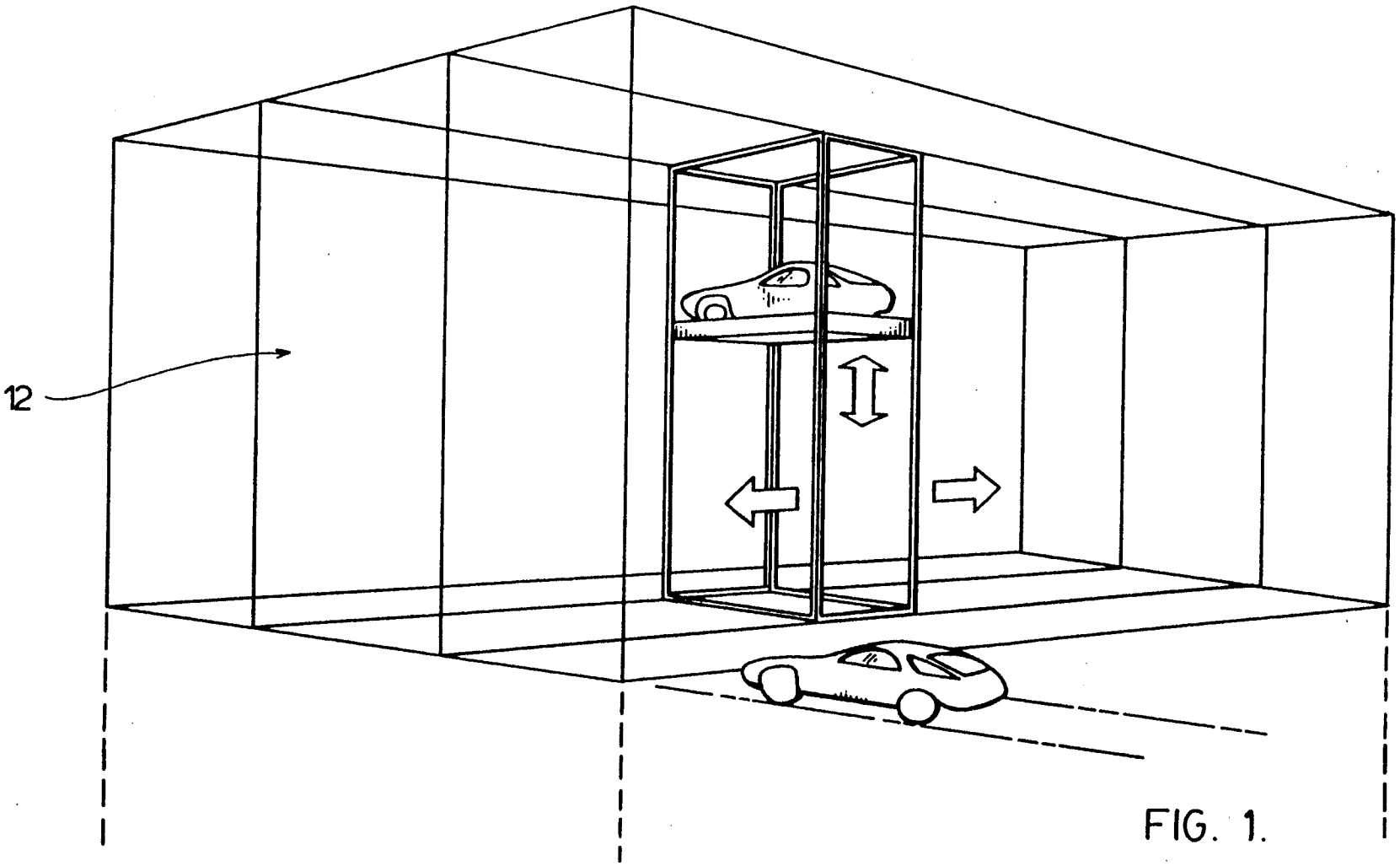
Figure 2:
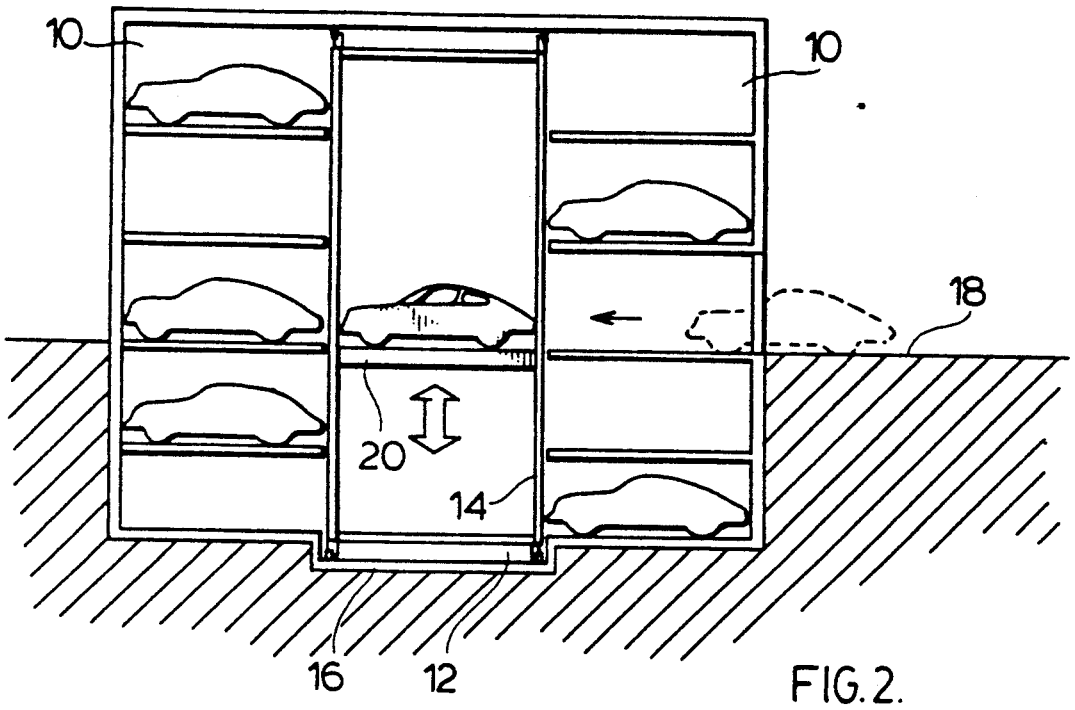
Figure 3:
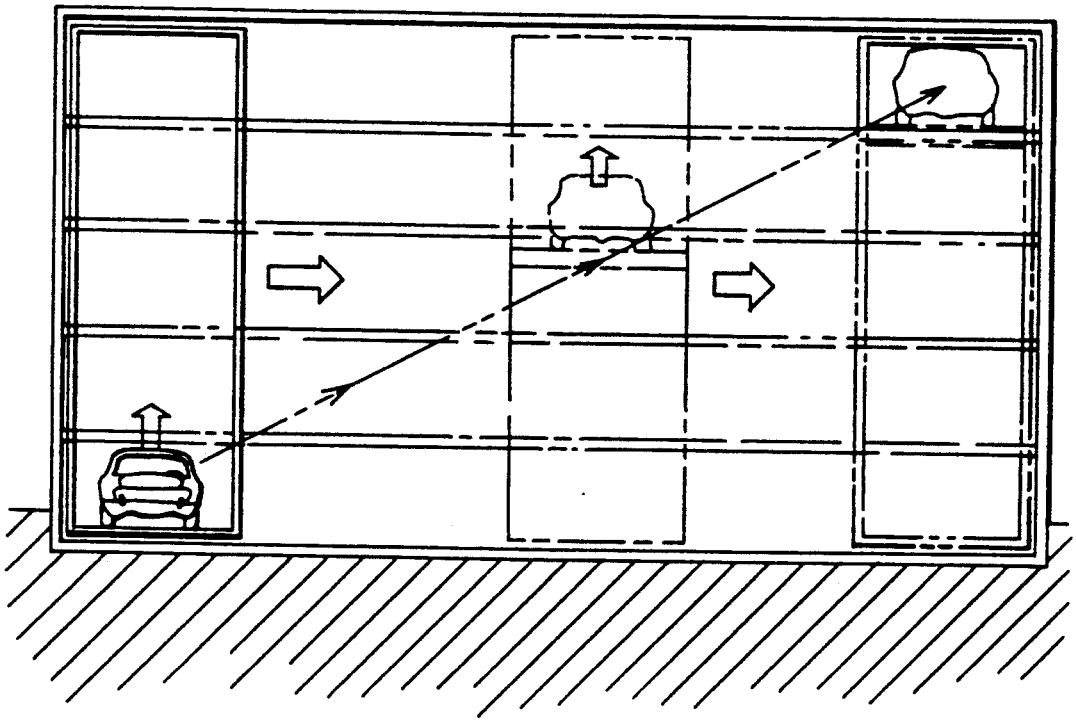
Figure 4:
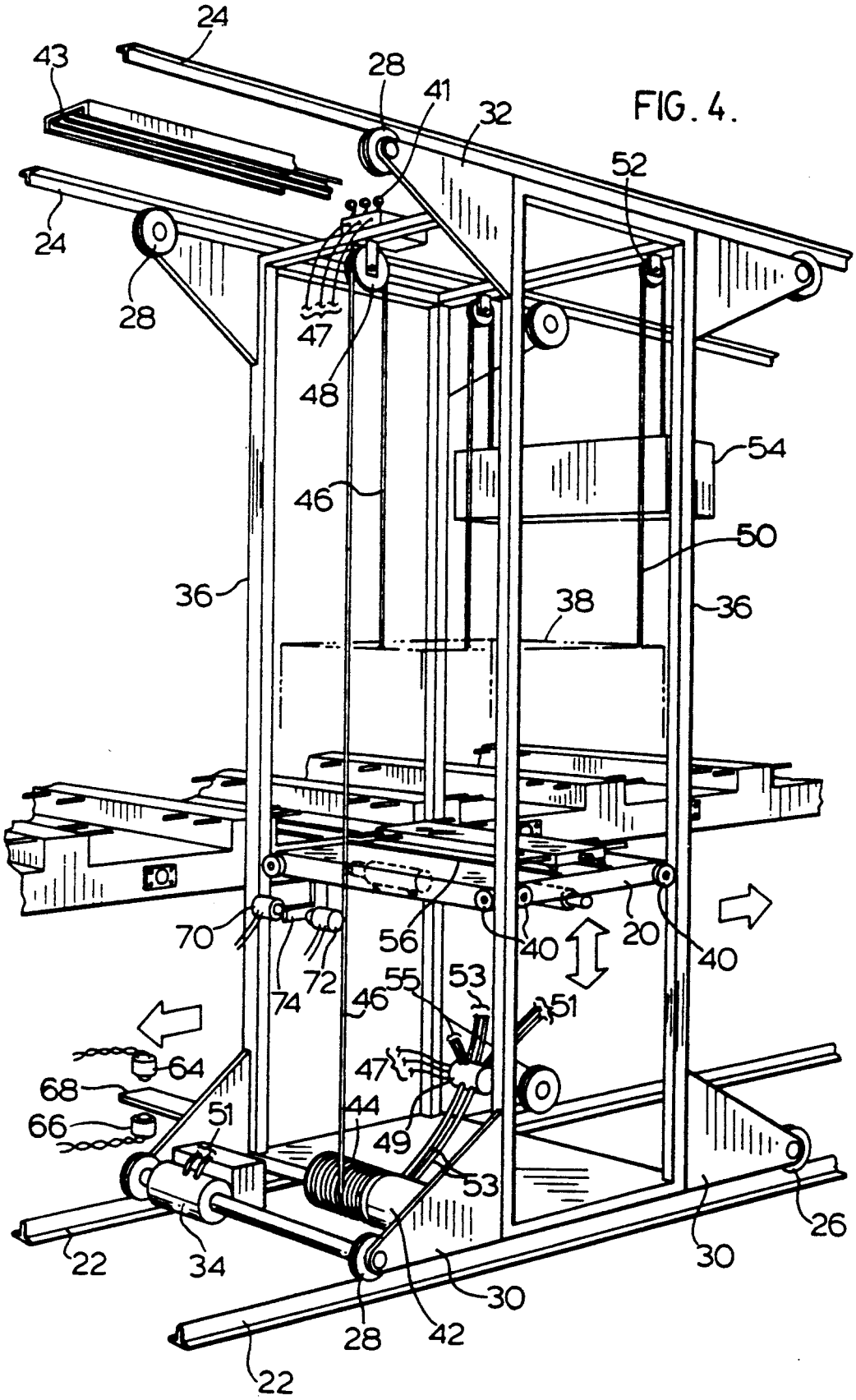
Figure 5:
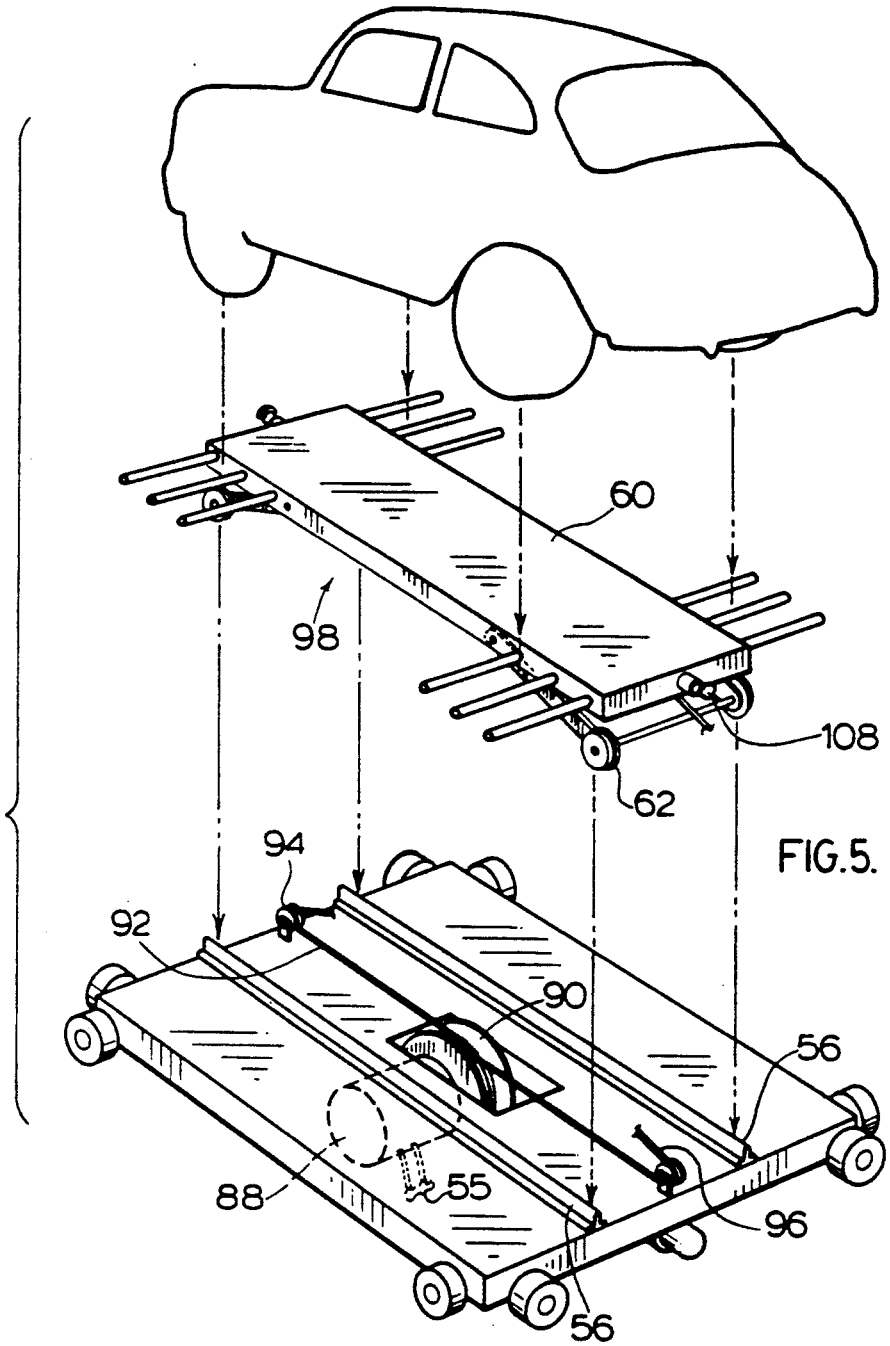

The garage is provided with lower main rails 22, upper main guide rails, 24 as shown in FIG. 4 to guide the translatory movement of the hoist. The hoist is provided with lower wheels 26 and upper wheels 28 adapted to run on rails 22 and 24 respectively. However it will be understood that the hoist and rails are designed so that the weight is totally supported on the lower rails 22 and the upper rails are for guidance only. The hoist structure base is extended in each sense in the translation direction by extension members 30 to mount wheels 26 running on the rails 22, the members 30 providing fore-and-aft stability for the hoist. The lateral stability for the hoist is provided by the overhead rails 24 on which run the upper wheels 28 of the hoist. The upper wheels 28 are similarly located on fore or aft projecting extension members 32 to the hoist frame to augment the stability of the frame.

The hoist lower structure is placed as low as possible, preferably about 4" off the ground.

On the lower structure, and, as low as possible, there is mounted a hydraulic translation motor 34 for driving two hoist wheels 26 for horizontal travel.

The hoist provides a vertically moveable platform 20 on a hoist car schematically indicated by dotted lines 38 which may arise in accord with the operation of the hoist to all levels of the bays moving on vertical guide rails 36. The vertical guide rails 36 and the car wheels 40 which run thereon to guide the vertical travel of platform 20 are schematically shown and may be embodied in any of a number of conventional manners.

The hoist base mounts the elevator hydraulic motor 42 operating cable drum 44. Cable 46 extends from drum 44 over pulley 48 mounted at the top of the hoist, to the top of the platform assembly 38. (It should be noted that elevator motor 42 and drum 44 are located toward the left side of the hoist frame in FIG. 4. Safety reasons will usually dictate the use of a second motor (not shown) to duplicate the first and normally sychronized for operation therewith. Each hoist motor and its suspension cable would then be adapted to operate the hoist independently in case of breakage of the other).

The power for hoist operation is provided by overhead electric lines 43 and the hoist is provided with corresponding glides 41 and leads 47 to pick off the electrical power. The leads 47 (omitted over the height of the hoists for clarity) are connected to drive an electric motor combined with hydraulic pump 49. Hydraulic pump 49 output is connected to translation motor 34 by leads 51 and to the vertical hoist motor 44 by leads 53. Leads 55 connect to the pump motor for cart operation. Other hydraulic functioning apparatus is supplied from pump 49 by hydraulic leads not shown. The selection of the on-off or intermediate states of the individual hydraulic motors or devices may be performed at the input of such motors or devices or at the corresponding individual outputs from motor-pump combination 49, in either case, by conventional means, well known to those skilled in the art. The sliding electrical power pick up in the translation direction plus the hydraulic operation at the bottom of the hoist provides a very stable and efficient operation and one that, other than the derived electrical power is completely self-contained on the hoist. Moreover two or more hoists may be operated on the same set of rails. Further, should one of two hoists break down, the other may be operated over the length of the rails since each hoist is independently controllable and operable. This is more fully discussed in connection with the embodiments shown in connection with FIGS. 17–26.

Cables 50 are extended upwardly from the top 38 of the frame over pulleys 52 rotatably mounted at the top of the hoist then downward to counter weight 54 guided, by any desired means not shown, for vertical travel on the hoist frame. The counter weight 54 balances the average weight of the hoist car and reduces demand on the hoist drive motor.

Mounted on the hoist frame for travel therewith is platform 20. Platform 20 carries parallel rails 56 (FIGS. 4 and 5) extending to the edge of the platforms in direction transverse to the longitudinal direction of the aisle. It will be noted that each bay 10 is provided with a set of matching rails 58 arranged to be aligned with, and abut, with a small clearance, rails 56 when a platform is properly aligned with a bay. Thus when the hoist platform is opposite a specified bay, a cart 60 rolls between rail pairs 56 and 58 to convey an automobile on the cart into or out of the bay. Thus cart 60 is provided with wheels 62 arranged to roll on rail pairs 56 or 58 for such travel.

General alignment of a platform with a bay may be performed in a large number of conventional ways and is not dealt with specifically herein. FIG. 4 shows a source and photocell 64 and 66 defining a photocell path corresponding to a translation station for the hoist corresponding to its alignment with a vertical column of bays 10. The hoist is (for example) provided with a corresponding interruptor plate 68 whose presence in the photocell path is sensed to indicate arrival of the hoist at the translation station. Similarly a hoist rail 36 is (for example) provided with a vertically disposed series (one is shown) of source-photocell pairs 70, 72 defining a path therebetween. An interruptor plate 74 travelling with the platform interrupts the cell path to indicate that the platform has arrived at a predetermined storey of the parking bays.

Figure 10:
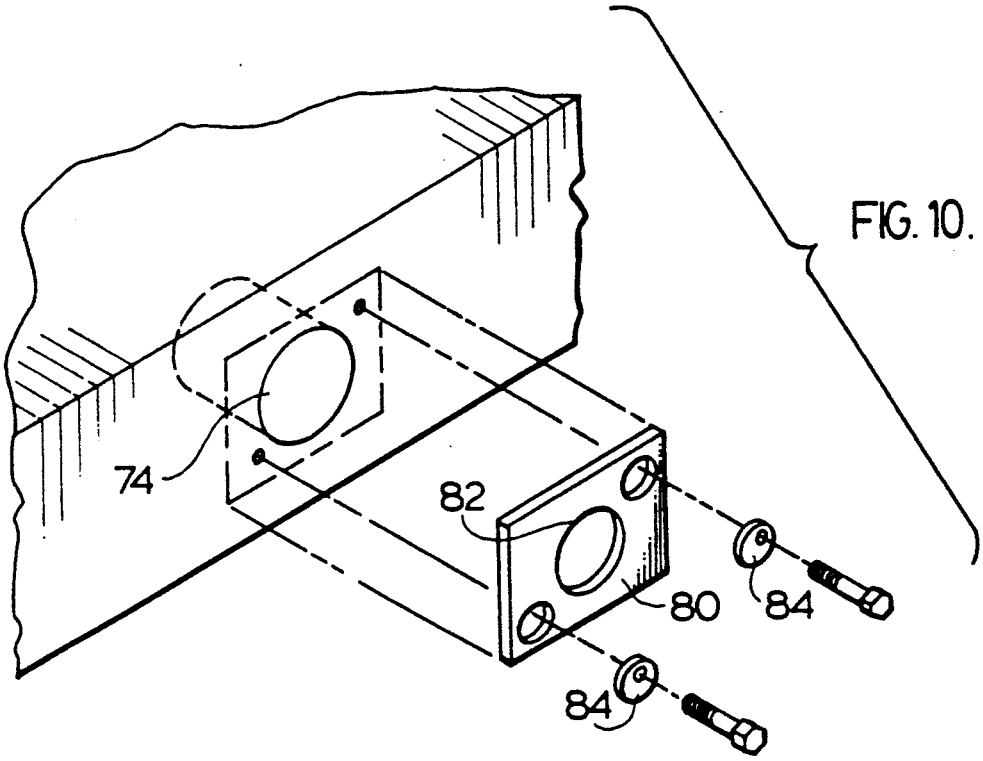
Figure 11:
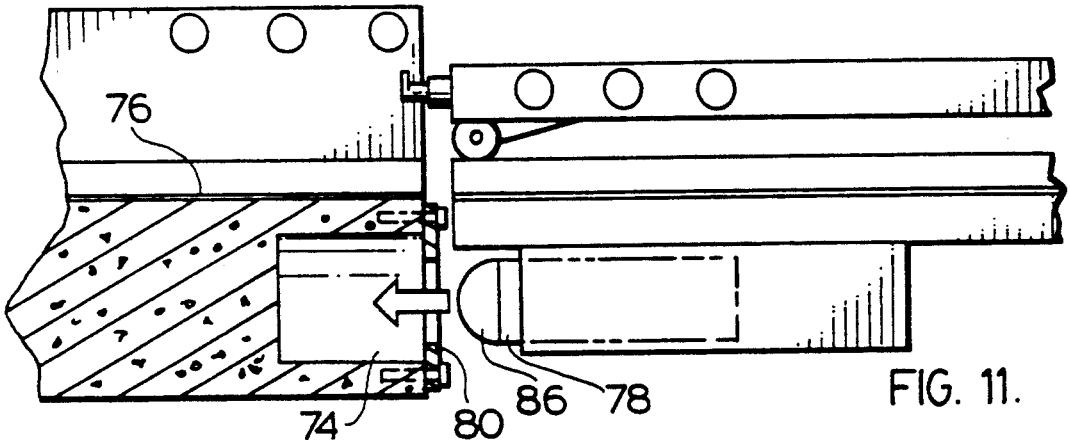
Figure 12:
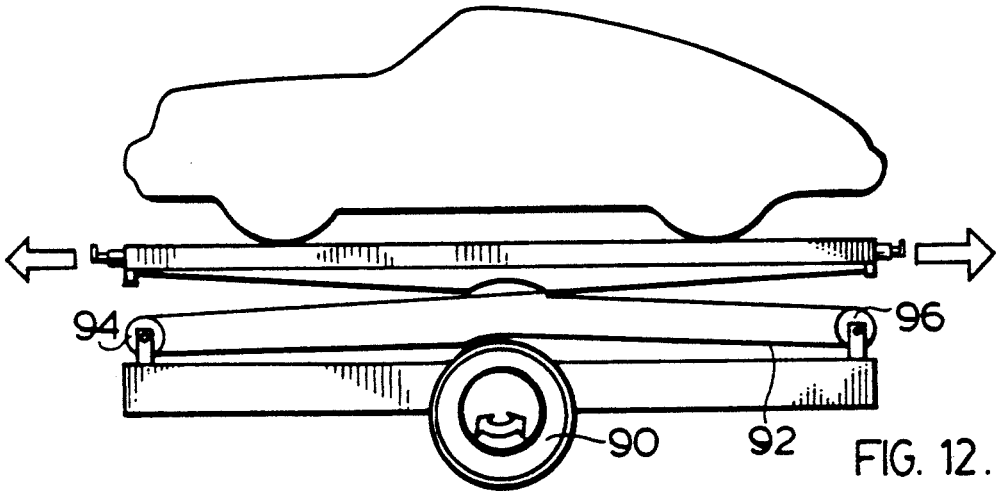
Figure 13:
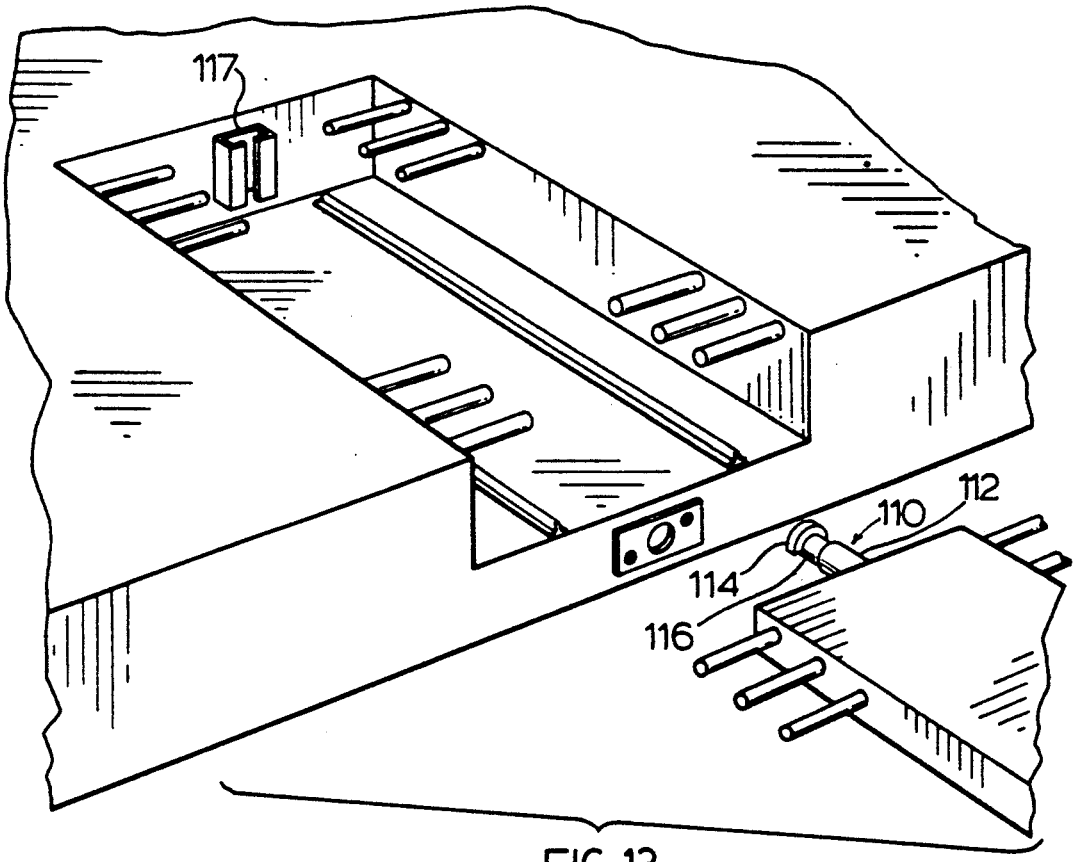
FIG. 13 is a perspective view showing means for establishing cart datum position in a bay.
Figure 14:
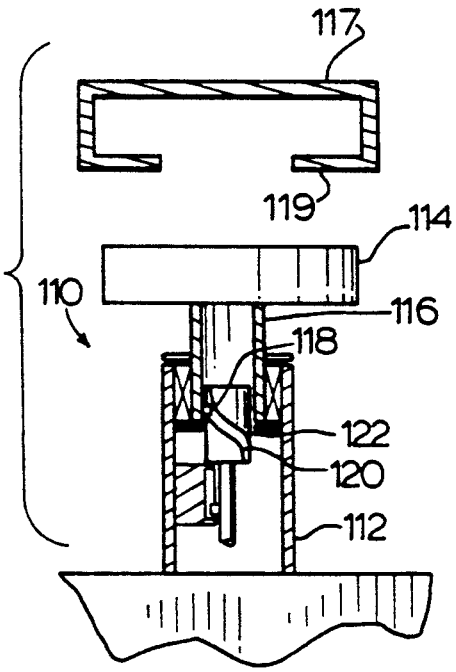
FIG. 14 shows the datum position lock in one position.
Figure 15:
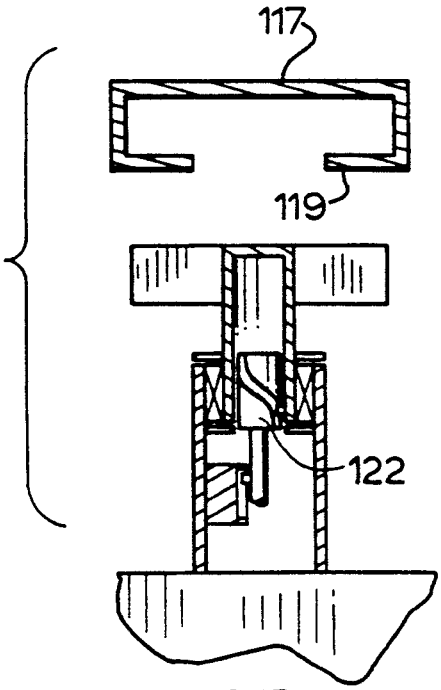
FIG. 15 shows the datum position lock in the other position.
Figure 16:
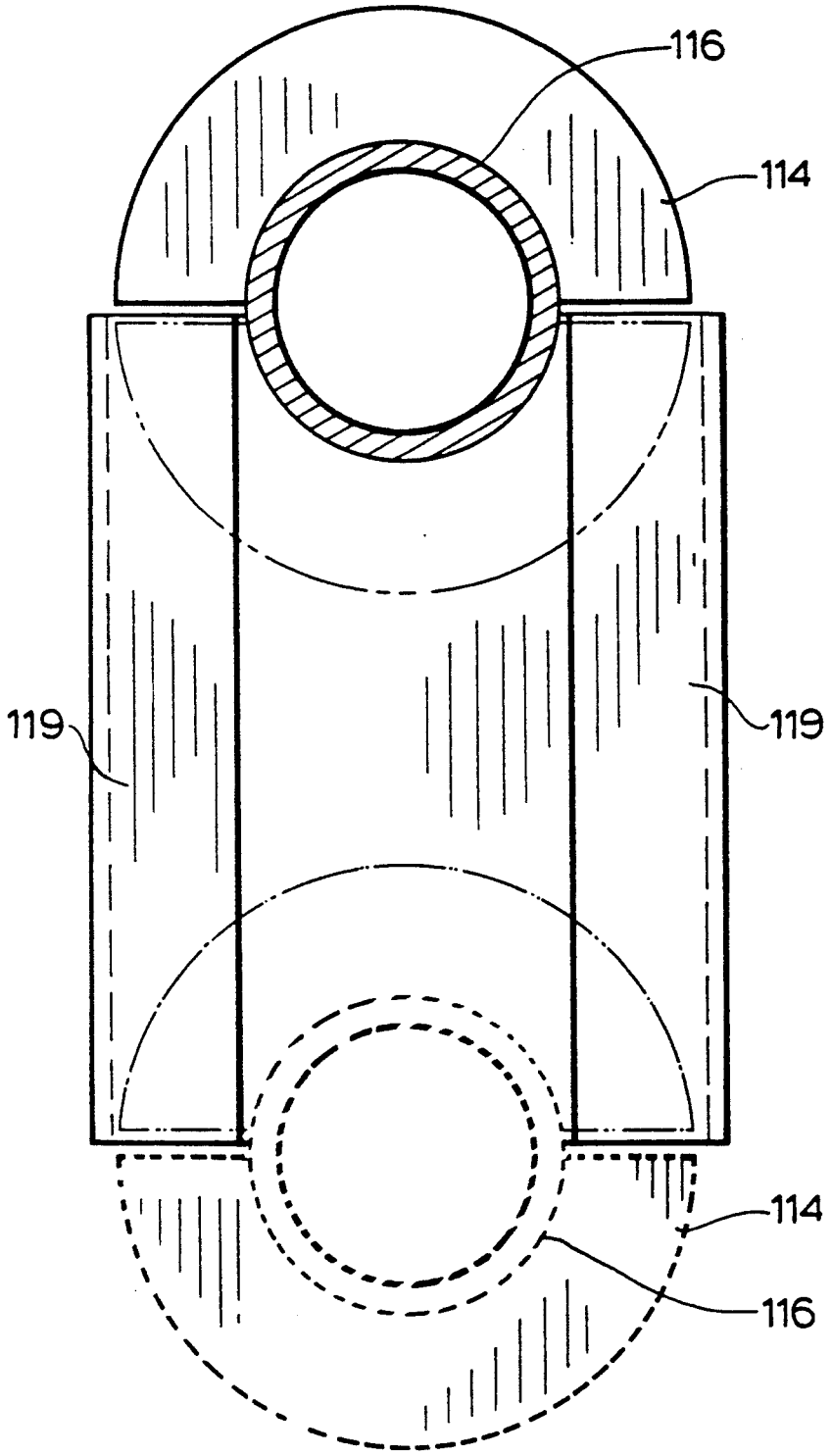
FIG. 16 shows an enlarged view of the datum locking dog.

Fine adjustment of the hoist car with a bay is provided by means such as that shown in FIGS. 10 and 11. Each bay 10 is provided with a recess 74 below the bay floor 76 for reception of an extendable-retractable probe 78 located on the cart to extend into the recess when the rail pairs 56 and 58 are aligned. The recess 74 ismade larger than required to receive the probe 78 and a coupling plate 80 with central aperture 82 is mounted over the recess and dimensional to make a sliding fit with the probe. Means, such as eccentric mounts 84, are designed to render each probe aperture 82 individually adjustable to ensure individual alignment of rail pairs at each bay. Any conventional means for individual adjustability of the probe sockets may be provided.

The probes 78 are also provided with rounded free ends 86 to give a camming action to achieve alignment when probe moves through the aperture in the plate.

The probes are provided with conventional retraction and extension means, not shown. Thus to align the platform with a bay, with the probe 78 retracted, the vertical hoist motor 42 and the horizontal translation motor 34 are operated to locate the platform in approximate alignment position as determined by translation station sensing means such as 64, 66, 68 and storey sensing means such as 70, 72, 74. With the platform in approximate alignment, the probe 78 is advanced to enter the bay aperture 82 and by the cam action of the probe end 86 to align the platform with the bay and bring the rails 56 into alignment with and near abutment with rails 58.

Car platform 20 mounts a hydraulic motor 88 operating a cable drum 90 located to drive a cable 92 over pulleys 94 and 96 located at opposite ends of the platform 20 with the cable flight direction corresponding to the directions of rails 56. The ends of the cable are attached to opposite ends of cart 98. The cable attachments to the cart geometry and the pulley location are arranged so that on rotation of the drum the cart 98 with or without an automobile thereon may be moved by the cable between a datum position inside a bay, on either side of the cart and the intermediate position where the cart is resting centered on the hoist platform for travel vertically therewith.

The cart is provided with wheels 62 adapted to run on rails 56, 58 and means for elevating and lowering a frame on the cart.

Figure 8:
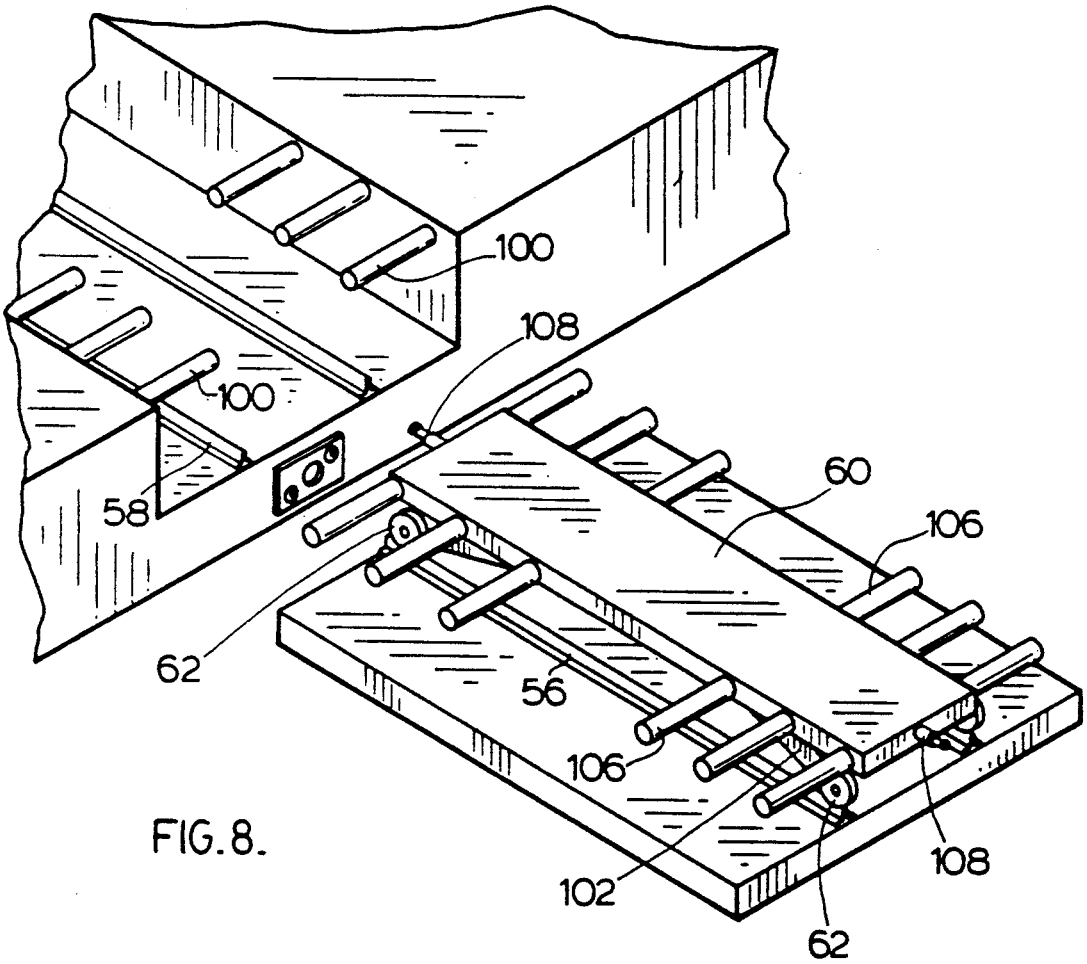
Figure 9A:
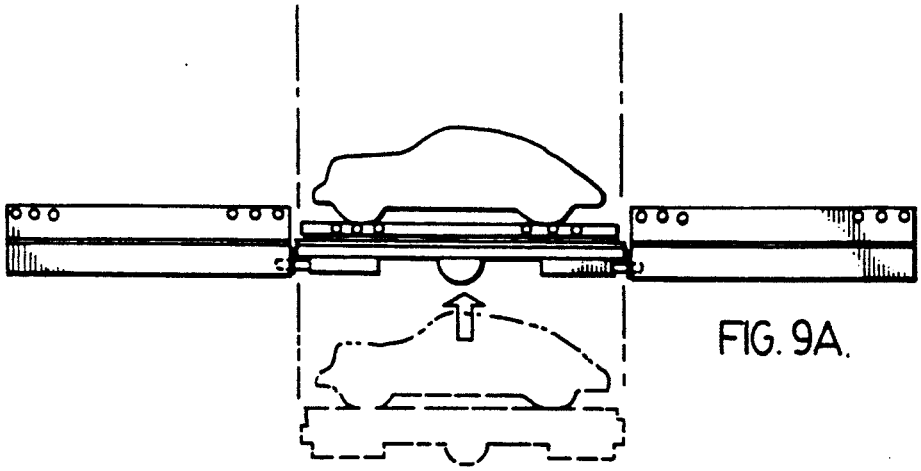
Figure 9B:
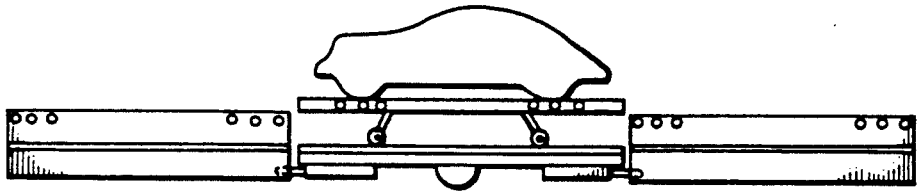
Figure 9C:
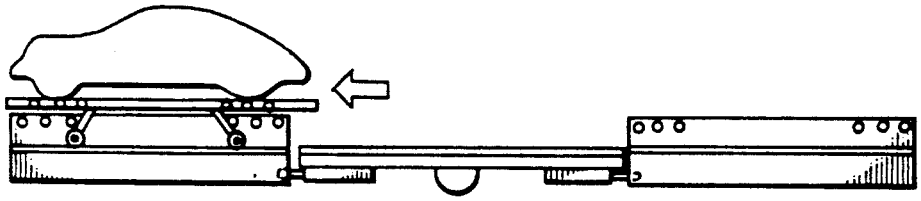
Figure 9D:
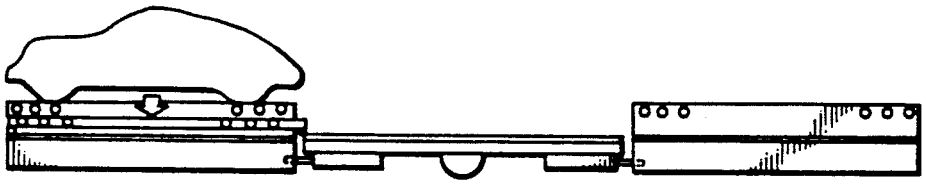
Figure 9E:
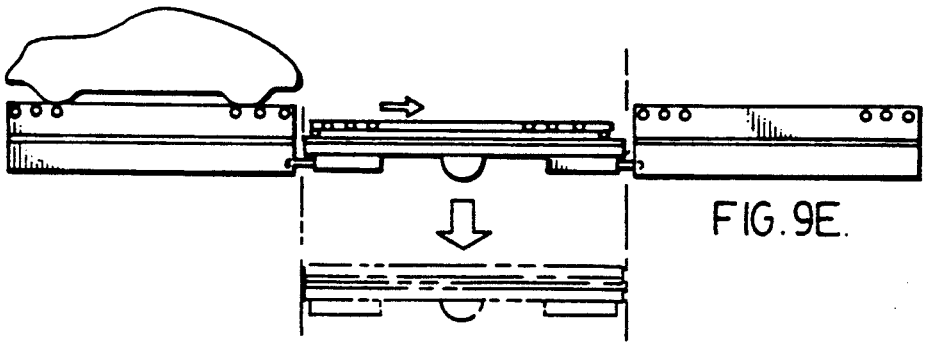

As shown in FIG. 8 each bay 10 is provided with two opposed sets of parallel rods 100 projecting inwardly to free ends over the rails 58. The sets of parallel rods 10 are spaced both laterally of the bay and along its length to support a pair of automobile tires on each set of rods. The sets of rods 100 are located sufficiently above rails 58 to allow passage of the cart frame 60 therebelow.

Figure 6:
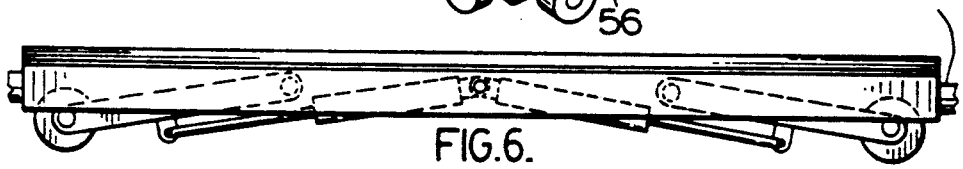
Figure 7:
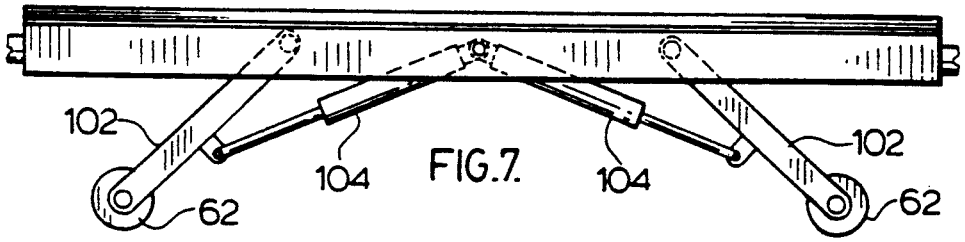

The cart is provided with a frame 60 carrying pivotted forwardly and rearwardly diverging links extending to wheels 62. A hydraulic cylinder and piston 104 is connected to the frame 60 and to each linkd 102 adapted to move the link between extended position (FIG. 7) and retracted position (FIG. 6). The hydraulic cylinders are provided with hydraulic supplies from controls and lines, not shown, and conventional means are available to cause the pistons to move the links from one position to the other in synchronism. The frame 60 is provided with two opposed sets of parallel rods 106 projecting outwardly from the frame to free ends. The sets of rods 106 are each designed to support two automobile tires thereon so that together they will support an automobile as will the two sets of rods 100.

Each set of rods 106 is arranged and spaced to pass between a corresponding set of rods 100. When the set of rods 106 passes upwardly between bars 100 it will lift an automobile off rods 100. When the set of bars 106 passes downwardly between rods 100 it will leave an automobile carried on rods 106 resting on bars 100.

Any conventional means may be used to provide a datum for the cart in the bay. However the preferred method is shown in FIGS. 13 to 16. In the preferred method each bay rear wall is provided with a vertically extending C channel 117 open toward the cart with two sides flanges 119 parallel to and spaced from the rear wall, running vertically and defining between them a vertical slot. The C channel terminates to allow clearance at its top and bottom for a purpose hereafter described. Each end of the cart in its translation direction is provided with the probe 110. The probe 110 comprises the fixed sleeve 112 in which is mounted for rotation but not translation the semicircular dog 114 and its mount 116, which has a central bore open toward the cart. The mount 116 is provided with a radially inward projection tooth 118 which rides in groove 120 of drum 122. Drum 122 is fixed against rotation but reciprocable in the cart translation direction into and out of the bore in mount 116. The groove 120 is designed, for each reciprocation (one direction) stroke, to rotate the mount 116 and dog 114 through 180°, between orientations with the semicircle above and below the diameter. The drum 122 is independently controlled by means not shown to move between retracted and extended position independent of the cart 98 location. To lower a car onto the bay rods 100 the frame 60 will be in the upward position as elsewhere described. The dog 114 will be in upward orientation. As the cart 98 is advanced into the bay dog 114 reaches a location just above the C channel with its semicircle uppermost. This location is sensed by means not shown. When sensed the control for drum 122 is operated to move the drum outward through its one direction stroke. The dog 114 is rotated 180° to rest within flanges 119 of the C-channel. The frame 60 is then lowered with the datum guidance provided by dog 114 riding behind flanges 119 until the car is resting on rods 100 and rods 106 on the frame are below. When the frame has reached the level where the diameter of dog 114 is below the lower extremity of the C-channel the cart is withdrawn from the bay but without rotation of dog 114.

When it is desired to remove a car from the bay, the cart with its frame lowered and dog 114 in semicircle down attitude is moved into the bay until dog 114 is below the C-channel. Drum 122 is then operated through a one directional stroke to rotate dog 114 through 180° so the semicircle is uppermost and the lateral edges of the dog 114 are riding behind flanges 119. The frame 60 is then raised moving under the datum guidance of dog 114 riding behind flanges 119. As bars 106 pass through bars 100 the car is lifted onto bars 106. When the diameter of dog 114 rises above the C-channel the car, frame and automobile are withdrawn onto the hoist platform bearing the auto but without rotating dog 114.

In operation, to park a car, the hoist and hoist platform are arranged so that the frame 60 is aligned with the automobile access location. The automobile is driven so that its tires are resting on bars 106. The car motor is turned off and it will be noted that the car motor will not again be required until the car is to be driven out of the garage from the access location. With the car on bars 106 the hoist is translated using motor 34 until the correct station for the selected parking bay is selected using sensors 64, 66, 68. The hoist motor 42 is operated to raise or lower the platform and frame 60 to the correct bay, using sensors 70, 72, 74. Probe 78 is advanced to complete the alignment of rails 56 with rails 58 with arms 111 vertical and with cylinders 104 operated to place platform 60 in the raised position, hoist motor 88 is operated to move the cart into the selected bay until probe 110 contacts the rear of the C-channel and rotates dog 114 to semicircle down orientation to act as a guide on the C channel flanges. Pistons 104 are then operated to lower the frame 60 so that individual rods 106 pass downwardly between individual bars 100, leaving the auto resting on rods 100. With rods 106 below rods 100 and the diameter of dog 114 below the C-channel the motor 88 is operated to return the cart to the platform. Probe 78 is retracted and the hoist translation and vertical movement may be used to move the platform to another location for use. To retrieve an automobile the platform is aligned with a bay as above described. With the frame 60 and rods 106 in lowered position the cart is moved into the bay until dog 114 is rotated to upper position to couple the frame to the C channel. Pistons 104 are then operated to raise the frame 60. Rods 106 passing between rods 100 raise the automobile off the latter on rods 106. With the diameter of dog 114 above the C-channel, the cart and automobile withdrawn and the hoist operated to move it to the access; retrieval location.

Although the horizontal movement of the hoist and vertical movement of the hoist platform are spoken of as separate operations, these may be performed simultaneously.

Although the cart shown is arranged so that the automobile is moved lengthwise into the bay it is equally possible to design the garage so that the automobile is moved sideways into the bay. In this event the bays will of course be shallower and wider. Also the auto will be driven at the access retrieval location at 90° to the direction of cart travel.

FIGS. 17–26 show the adaptation of the hoist of FIGS. 1–16 to provide a substantially straight transverse aisle 200, leading transversely from the central or main aisle 212; and substantially straight extension aisles 202 at the ends of the main aisle. Central aisle 212 is also substantially straight and bears the same relationship to the parking bays as did the aisle to the bays in FIGS. 1–16.

The purpose of the transverse aisle 200 or extension aisle 202 is to provide a location to house a hoist 214 for maintenance or repair while leaving the main aisle free for use by another hoist. The hoist 214 is generally similar to the hoist 14 with differences for transfer to a transverse aisle 200 as hereinafter described. The development of FIGS. 17–26 is therefore suitable for use with multiple hoists. When all hoists are operating, they may share the main rails. When one of the hoists requires maintenance or repair it may be placed in a transverse or extension aisle in accord with the description to follow. So far as the extension aisles 202 are concerned these are extended beyond the bays at one or both ends. Thus the lower guide rails 22 and the upper guide rails 24 are extended beyond the bay locations into each extension aisle, to guide the hoist lower wheels 26 and upper wheels 28, respectively. For providing the electric power to run the hydraulic pump to provide hoist translation, platform travel, and the other hoist functions, as previously described, the electric leads 43 are similarly extended into each extension aisle, and the glides 41 run thereon into the extension aisles as described in connection with FIGS. 1–16.

As shown in FIG. 18 cross rails 204 are provided extending transverse to bottom rails 26 and into transverse aisle 200. The cross rails 204 are provided with base web 206 and side flanges 205. The base web 206 is located at a height above or level with the upper surface of rails 26, so that transverse hoist wheels 226, (whose operation will be hereinafter described) may run in cross rails 204 to support the hoist on travel into and out of the transverse aisle. Gaps 208 as shown are provided in rails 204 to allow the free passage of wheels 26 along with adjacent parts of the hoist along main rails 22 past the transverse rails. The transverse wheels 226 are made large enough, relative to the gaps 28 that the trailing pair on entrance into the transverse aisle may traverse the gaps and make the same traverse on rolling out of the transverse aisle.

As shown in FIG. 18 one of the pair of transverse wheels 226 nearer transverse aisle 20 is driven for rotation by hydraulic motor 213, with hydraulic fluid for the motor 213 supplied along lines 215 from the hydraulic pump 49 (see FIG. 4). The hydraulic lines 215 are not shown in FIG. 4 but, like the lines 51, 53, 55 shown, will supply the output of the pump to motor 213. The selection of when to operate motor 213 by the supply of fluid along lines 215 may be made by conventional controls, not shown, at motor-pump combination 49 or at motor 213, as with the other hydraulic equipment. If desired, or necessary for the smooth operation of the hoist, both wheels 226 facing the transverse aisle may be hydraulically powered.

Each of the four wheels 226 is mounted on a vertically travelling piston rod, not shown riding on a piston, not shown, in hydraulic cylinder 217. Each piston is operable between retracted and extended position by hydraulic fluid supplied along lines 219 connected to pump 49 of FIG. 4 (although not shown in that Figure) and selectively operated to move the pistons 217 between retracted and extended position. In the retracted position wheels 226 will clear the top of flanges 204 with wheels 26 supporting the hoist on rails 22. In the extended position wheels 226 will support the hoist while rolling on rail base 206 with wheels 26 clear of rails 22. Means, not shown are provided to ensure the four pistons 217 are operated in concert and to maintain the hoist in level orientation during such movement.

On each side wall of the transverse aisle are a pair of facing U channels 219'. The channels are located toward the upper extremity of the hoist but below the supports for upper wheels 28. The hoist is provided with four wheels 221 mounted on the outside of the four vertical guide rails, shaped and located so that a pair will roll in each of channels 219. The channels 219' and wheels 221 are located so that their height will coincide when pistons 217 are in their extended position.

In the embodiment of FIGS. 17-26 the upper wheels 28 are mounted to run on rails 24 outboard to the front and rear as in the earlier embodiment. However in the embodiment of FIGS. 17-26, the wheels 28 are mounted on supports 232 which are pivotally mounted on the hoist frame at pivots 234 to pivot on transverse axis relative to the frame. The lower ends of supports 232 on the same side of the hoist are each provided with a linkage connector 221 to the piston rods of opposed pistons, not shown, travelling in piston cylinder 223. Hydraulic line 225 connects to each end of cylinder 223 outside the respective pistons while hydraulic line 227 connects to cylinder 223 between the cylinders. Under control of the hydraulic fluid in lines 225 and 227 the linkage may be operated between an extended position (FIG. 24) where wheels 28 ride on rails 22 to guide the upper end of the hoist; and a retracted position (FIGS. 25 and 26) where the wheels clear rails 22, and it will be noted that the wheels 28 are given sufficient clearance in the retracted position that they clear rails 22 in the extended position of pistons 217.

In the embodiment of FIGS. 17-28 there are, in addition to, the main electric lines 43, transverse electric lines 243 each respectively connected to their lines 43 counterparts as best shown in FIG. 23. Transverse electric lines 243 are parallel to and centred over transverse rails 204 to supply power to the hoist for travel along the transverse aisle 200. The hoist is provided with main glides 41 as in the earlier embodiment and transverse glides 241 as best shown in FIGS. 23-26. Glides 41 are designed under controls, not shown to move from the extended position of FIGS. 24 and 25 when the hoist is operating on main rails 22, to the retracted position of FIG. 26 when the hoist is operating on transverse rails 204. It will be noted that the drop in glides 41 to the retracted position must be sufficient to clear lines 43 and rails 24 when the hoist is raised by pistons 217. Glides 241 are designed, under controls not shown, to move from the retracted position of FIG. 24 to the extended position of FIGS. 25 and 26. In the retracted position glides 241 are clear of lines 243. If desired the retracted position of glides 241 may be located inboard of the sides of the hoist to avoid providing widened slots for their extensions along the main aisle. It will be noted that lines 247 from glides 241 join their respective counterparts in lines 47 from glides 41 so that motor 49 is driven by power from glides 41 or 241.

FIG. 27 is a schematic view showing the operation of electric motor-pump combination 49 and the electric-hydraulic drive. As shown in FIG. 27 the power along lines 47 from either glides 41 or 241 is provided to drive electric motor 61 on the motor-pump device 49. Electric motor 61 drives hydraulic pump 65 which supplies and receives hydraulic fluid along lines 67 to manifold 69. The switcher 71 is controlled by control selector 73 to the selected devices connected to the motor pump drive 49 and in the selected sense. Thus the motor 61 may be considered as driving pump 65 at all times, when the hoist is operating and the hydraulic fluid from pump 61 is available on lines 67 to drive devices as selected by selector 73. In the embodiment of FIGS. 1-16 this includes lines 51, 53 and 55 to motors 34, 42 and 88 respectively and other hydraulic devices. In the embodiment of FIGS. 17-27 hydraulic fluid is selectively supplied over lines 215, to motor 213, over lines 219 to pistons 217 and over lines 225 and 227 to cylinder 223 and to other hydraulic devices as well as those devices listed in connection with FIGS. 1-16. The actual supply of hydraulic fluid to devices as and when selected is controlled by valving in switcher 71.

This arrangement with the hoist and garage described emphasizes the fact that applicant's hoist is a self-contained device with all the electro-hydraulic drive means required to drive and operate the hoist self-contained or the hoist itself.

The physical construction of the transverse aisle has not been shown. However, it is understood that the transverse aisle is made wide enough to receive the hoist travelling sideways with its endwise projections.

In operation, with the hoist operating in the main aisle, wheels 26 are supporting the hoist on rails 22, wheels 28 are guiding the hoist on rails 24 and glides 41 are deriving the electric power from lines 43. Pistons 217 and glides 241 are retracted. When it is desired to place the hoist in the transverse aisle it is operated until wheels 226 are over rails 204 (FIG. 19). Glides 241 are extended (FIG. 25) to contact lines 243 and maintain electrical power to the hoist. Glides 41 then are retracted from lines 43 (FIG. 26). Links 221 and supports 232 are retracted, so wheels 28 are removed from rails 24. Pistons 217 are activated to extended position so that wheels 226 contact rails 204 and raise wheels 26 clear of rails 22 and align wheels 221 with channels 219. The glides 241 are biased and flexible to maintain contact during this movement. The hoist is operated by activating motor 213 to drive the hoist along rails 204 and wheels 221 enter channels 219 to guide the top of the hoist. When the hoist is clear of the main aisle another or any number of hoists may operate on the main rails while the first hoist is repaired in the transverse aisle.

To return a hoist to the main from a transverse aisle, the hoist is translated until wheels 26 are over rails 22 and wheels 28 under rails 24. The glides 41 are then extended to contact rails 43. The pistons 217 are then operated to lower the hoist until wheels 26 support it on rails 22 and then to raise the wheels 226 clear of rails 204 and of rails 22. The glides 241 are retracted from lines 243 and the supports 232 are extended so wheels 28 may ride on rails 24. The hoist is again operable in the main aisle.

Instead of using four individual pistons 217, the four wheels 226 may be placed on a single retractible cart and operated by a single piston or jack to perform the same function as the pistons 217.

The parking system disclosed is suitable for rapid and convenient storage and retrieval of automobiles. Although individual components and features may appear to duplicate those found on hoists and systems for other storage areas, the combinations disclosed and claimed herein are particularly directed to the fact that the system is used for autos which are heavier then most articles stored in other storage systems.

Included in the features disclosed herein relevant specifically to automobile storage are:

The aisles are straight because the necessary weight of the hoists with or without a car thereon render it impractical to design the hoist and its supports for a curved path;

the hoists are preferably solely supported from below although they may be guided at the top. The weight of the loaded or unloaded support renders it comparatively impractical to support it from the top;

for stability and ease of access the electric and hydraulic motors and controls are located at the base of the hoists; and the hoist units have an electric power take-off but are otherwise completely independently operable. Thus a number of hoists may be used at once and a hoist may be independently moved to a transverse or extension aisle leaving the main aisle free for operation by another hoist or hoists.

I claim:

1. Parking garage for automobiles with facing storage bays, said parking garage comprising:

a substantially straight main aisle separating said storage bays, each said bay having an opening facing said main aisle, a hoist movable horizontally along said main aisle, said hoist providing a platform adapted to receive an automobile from a loading area, said hoist being adapted to move said platform and automobile vertically to the level of a selected one of said bays, means to more horizontally said hoist along said main aisle whereby by a combination of such vertical and horizontal movement, said hoist may move said platform between said loading area and alignment with one of said bays, means for transferring an automobile between said hoist and said loading area and between said hoist and a selected one of said bays, a substantially straight transverse aisle intersecting said main aisle at approximately 90° opening into and extending transversely from, one side of said main aisle, means defining said transverse aisle adapted, in combination with said transverse aisle, to house said hoist clear of said main aisle, whereby another hoist may use said main aisle when said hoist is housed in said transverse aisle, means to move a hoist between said main aisle and said transverse aisle including main rails running along said main aisle and main wheels mounted on said hoist designed to roll on said main rails and support said hoist thereabove; transverse rails running along said transverse aisle and a short distance across said main rails, transverse rails including gaps in said transverse rails in the vicinity of said main rails adapted to allow the passage of said main wheels on said main rails, transverse wheels on said hoist each movable between a retracted and extended position, in the retracted position said transverse wheels allowing said hoist to travel with said main wheels on said main rails, in the extended position said transverse wheels being adapted to support said hoist with said transverse wheels on said transverse rails and said main wheels clear of said main rails, said transverse wheels being adapted, in extended position to cross the gaps in said transverse rails.

2. Parking garage as claimed in claim 1 including:

main electrical lines extending along said main aisle near the top thereof, main glides mounted on said hoist adapted in an extended position to run on said electrical lines and derive the power for translating said hoist on the main rails, means on said hoist adapted to receive said power derived by said main glides and translate said hoist along said main rails, transverse electrical lines extending along said transverse aisle near the top thereof, transverse glides mounted on said hoist adapted, in an extended position, to run on said electrical lines and derive the power for translating said hoist on the transverse rails, means on said hoist adapted to receive said power derived by said transverse glides and translate said hoist along said transverse rails, said main glides being movable between extended and retracted positions in correspondence with movement of said transverse wheels between retracted and extended positions; and said main glide moving means being adapted to selectively maintain said main glides clear of said main lines in the extended position of said transverse wheels, said transverse glides being movable between retracted and extended positions in correspondence with movement of said transverse wheels between retracted and extended positions; and means being adapted to maintain said transverse glides clear of said main lines in the retracted position of said transverse wheels.

3. Parking garage as claimed in claim 1 wherein said main aisle is joined to a substantially straight extension aisle extending beyond said bays in at least one direction, means defining said extension aisle, adapted in combination with said extension, to house said hoist clear of said main aisle, whereby said hoist may use said main aisle when another hoist is housed in said extension aisle.

4. Parking garage as claimed in claim 1 wherein said hoist includes main hydraulic motor means located near the base of said hoist, connected to drive at least one of said main wheels to move said hoist horizontally along said main aisle.

5. Parking garage as claimed in claim 4 wherein conversion means are provided adapted to use electric power derived from electrical lines located above said hoist to drive a hydraulic pump which in turn drives said main hydraulic motor means.

6. Parking garage as claimed in claim 5 including hoist hydraulic motor means located near the base of said hoist, connected to raise and lower said platform.

7. Parking garage as claimed in claim 5 wherein transverse hydraulic motor means are located near the base of said hoist, and are connected to drive at least one of said transverse wheels to move said hoist along said transverse aisle.

8. Parking garage as claimed in claim 7 including hoist hydraulic motor means located near the base of said hoist connected to raise and lower said platform, said hydraulic pump being connected to drive said hoist hydraulic motor means.

9. Parking garage as claimed in claim 7 wherein said hydraulic pump drives said transverse hydraulic motor means.

10. Parking garage as claimed in claim 9 including hoist hydraulic motor means located near the base of said hoist, connected to raise and lower said platform.

* * * * *